US005993143A

United States Patent [19]

Eltze et al.

[11] Patent Number: 5,993,143

[45] Date of Patent: Nov. 30, 1999

[54] TRANSFER DEVICE FOR SHEET METAL PARTS IN A PRESS SYSTEM

[75] Inventors: Juergen Eltze; Hans Hofele, both of Goeppingen, Germany

[73] Assignee: Schuler Pressen GmbH & Co., Germany

[21] Appl. No.: 08/891,873

[22] Filed: Jul. 9, 1997

[30] Foreign Application Priority Data

Jul. 13, 1996 [DE] Germany ..... 196 28 333

[51] Int. Cl.[6] ..... B65G 65/08

[52] U.S. Cl. ..... 414/752; 198/468.4; 901/15

[58] Field of Search ..... 414/749, 752, 414/733, 736, 737; 294/65; 198/465.4, 468.4, 468.6; 100/207; 901/40

[56] References Cited

U.S. PATENT DOCUMENTS 4,921,387 5/1990 Bennington ..... 198/468.6
5,257,899 11/1993 Asakura et al. ..... 414/752
5,388,952 2/1995 Hofele et al. .

FOREIGN PATENT DOCUMENTS 0 499 901 A1 8/1992 European Pat. Off. .
62-142431 2/1986 Japan .

*Primary Examiner*—Donald W. Underwood
*Attorney, Agent, or Firm*—Evenson McKeown Edwards & Lenahan P.L.L.C..

[57] ABSTRACT

A transfer device for press systems has cross traverses with at least one suction unit swivellably held thereon. The suction unit has an electric drive for coordinating the swivel movement with the transfer curve (horizontal and vertical movement) to be travelled. As may be required, two or more suction units can be independently swivellable on a cross traverse. A retrofitting and retooling of existing cross traverses can be carried out by the replacement of non-swivellable suction units used so far by swivellable suction units. Other changes on the mechanical structure of the transfer device are not required.

12 Claims, 5 Drawing Sheets

TRANSFER DEVICE FOR SHEET METAL PARTS IN A PRESS SYSTEM

BACKGROUND AND SUMMARY OF THE INVENTION

This application claims the priority of 196 28 333.7, the disclosure of which is expressly incorporated by reference herein.

The present invention relates to a transfer device, and more particularly, to a transfer device for transfer of workpieces between press stations along a given transfer direction, comprising supporting and guiding devices which extend essentially along the transfer direction and which carry therebetween cross transverses equipped with gripping devices arranged to be engaged with and disengaged from the workpieces, and driving devices configured to act upon the gripping devices for swivelling the gripping devices about an axis of rotation transverse to the transfer direction.

In press systems having several press stations which are arranged behind one another along a parts passage route, transfer devices are provided which remove the corresponding sheet metal parts from the press stations and supply them in a timed manner to the respective press station which follows. Intermediate depositing devices are usually provided between the individual press stations so that the workpieces to be transported can temporarily be deposited thereon to permit a reduction of the transfer step width. For carrying out the transfer, a transfer device is used which grips the workpieces when the tool is open and, in a transfer movement during which a lifting movement is superimposed on a horizontal transfer movement, guides them out of the tool or inserts them therein. Thereby, a vertical lowering or depositing movement is superimposed on the transfer movement.

Particularly with workpieces which have complicated designs and/or workpieces which are to be placed in the tools obliquely, i.e., deviating from a horizontal plane, it may be necessary, during, for example, the guiding out of or guiding into the tool, to swivel the workpiece about a transverse axis. In the case of corresponding tool and workpiece shapes, this transfer may become necessary in order to avoid a collision between the sheet metal part and the tool during the transfer movement. The first machining station of press systems, optionally also a machining station which follows, is configured as a drawing station. The further machining may require an oblique position of the sheet metal part in the bottom tool. On one hand, for example, because of the high lift numbers, the lifting-out lift cannot be selected to be arbitrarily large. On the other hand, it is necessary to guide low-placed drawn surfaces which are bent by deep-drawing freely past above the form of the bottom tool.

A conventional transfer device is shown in EP-A-0 499 901 and includes two guide rails which extend in the transfer direction. The guide rails are arranged on the right and the left side next to the tools of the press stations, travelling carriages being disposed on these guide rails. The guide rails are connected with a lifting and lowering unit in order to carry out a targeted horizontal movement. The travelling carriages are connected with a transfer drive unit in order to be moved along the travelling rails in a targeted manner. Each cross traverse is arranged between two carriages and is rotatably on the end side disposed on the carriages. As gripping devices for gripping and holding sheet metal parts, the cross traverse carries a suction spider which has a number of suction feet which can be acted upon by a vacuum. In order to be able to swivel the suction spiders about a transverse axis, the corresponding cross traverse is connected on the end side by a coupling with a swivel lever which can be swivelled with a driving cylinder provided on the carriage.

In order to limit the usability of the transfer device not to applications in which rotational movements of the workpieces are required in only one or in a few stations, all carriages must be equipped with corresponding rotating units. This makes the construction more complicated and increases the weight of the transfer device and particularly of the carriages. Correspondingly high accelerating and braking forces are thus applied which is disadvantageous with respect to energy consumption. Furthermore, the known construction requires considerable space which reduces the permissible lifting height of the cross traverse transfer system. The known transfer device is unlike the ideal transfer design which could handle a plurality of workpieces so that it can also be set up for future tasks which cannot be predicted in detail.

JP 62-142431 describes a transfer device with a support carrying the suction spider and, as a whole, is rotatably disposed on a rotating unit. The rotating unit is held on a support which can be moved vertically up and down as well as horizontally.

If a corresponding transfer device is to have several such transverse supports, a rotating unit is required at each transverse support position irrespective of whether, for the concrete individual case and at the respective position, a swivel movement of the suction spider is actually required. This affects the constructive expenditures and the weight of the transfer device.

An object of the present invention is, therefore, to provide a transfer device which permits a high variability.

This object has been achieved in accordance with the present invention by a transfer device at least one of the cross traverses carries a bearing device on which the associated gripping device is operatively disposed to be swivelled about the axis of rotation, and this at least one cross traverse is configured to carry the driving device for swivelling the gripping device.

The cross traverses, which have a rigid construction per se, carry suction spiders which are each rotatably disposed thereon. The cross traverse also carries the driving device, such as a geared motor, hydraulic or pneumatic drives and the like which, as required, swivel the gripping devices. Thus, cross traverses with swivellable gripping devices can be provided at positions of the transfer device which constructionally correspond to those positions which are developed for cross traverses with non-swivellable gripping devices.

Regardless of whether the corresponding cross traverse carries swivellable gripping devices or not, the end-side suspension of the cross traverses has a uniform construction. No rotating units are required which act upon the ends of the cross traverses and which would have to be fixedly provided on the supporting and guiding devices, for example, on travelling carriages disposed on travelling rails. This permits the fast exchange of cross traverses with rotatable gripping devices for cross traverses with non-swivellable gripping device and viceversa. The constructive and economic expenditures are therefore reduced to the respective required extent for each application. Simultaneously, the transfer devices offers a high measure of variability and permits a fast adaptation to different, also future transfer tasks which presents no problems.

Because driving devices acting upon the gripping devices are to be provided only at such positions or cross traverses at which they are actually necessary, the mass of the transfer device which is to be accelerated and braked is not increased by unnecessary driving devices which are to be moved along. A fast transfer and a lowering of the driving/braking power are thereby permitted.

The swivellable bearing of the gripping devices on the cross traverse and the assignment of a driving device carried by the cross traverse to each gripping device provides the basis for the fact that gripping devices provided on one and the same cross traverse are divided into gripping units which are to be controlled or swivelled differently. For example, on one cross traverse, a first and second suction spider may be provided of which only one is swivelled or which are swivelled differently. Thus, sheet metal parts can be handled which are to be swivelled differently and which are to be transported through the press stations side-by-side. This may become necessary if two separate sheet metal parts which have different shapes are formed from one sheet bar.

As a result, the versatility of the transfer device according to the present invention even makes it possible that a sheet metal part which, as a cutout for forming a large opening in another sheet metal part, was separated from the latter can be synchronously conveyed together therewith and can be shaped into a separate part. It can be held, transported and changed into different tilting angles by a separate suction spider which is disposed on the same cross traverse as the suction spider for the surrounding larger part.

A coupling arrangement between the cross traverse and the gripping devices or a gripping unit formed of gripping devices, a bearing device and driving devices can, as required, permit the release of the gripping unit from the cross traverses so that the cross traverses can be retrofitted for a respective application. In particular, swivellable gripping devices/units can be exchanged for non-swivellable gripping devices/units.

The axis of rotation of the gripping devices is preferably situated within the cross traverse, and the center of gravity of the workpiece is situated below the cross traverse. Consequently, no significant torque is created by the force of the weight of the workpiece which would act upon the driving devices.

In a construction type which can be easily retrofitted manually, the bearing device includes at least one divided bearing unit which has two curved guiding surfaces on which the gripping devices are disposed by way of rollers. A gear wheel segment is used for the coupling with a geared motor serving as the driving device and can also be considered to be a bent toothed rack. This construction permits a particularly low height of the swivellable gripping unit which is no larger or hardly larger than that of the non-swivellable unit. This does not limit the permissible vertical lift of the transfer device.

BRIEF DESCRIPTION OF THE DRAWINGS

Other objects, advantages and novel features of the present invention will become apparent from the following detailed description of the invention when considered in conjunction with the accompanying drawings wherein.

DETAILED DESCRIPTION OF THE DRAWINGS

Figure 1:
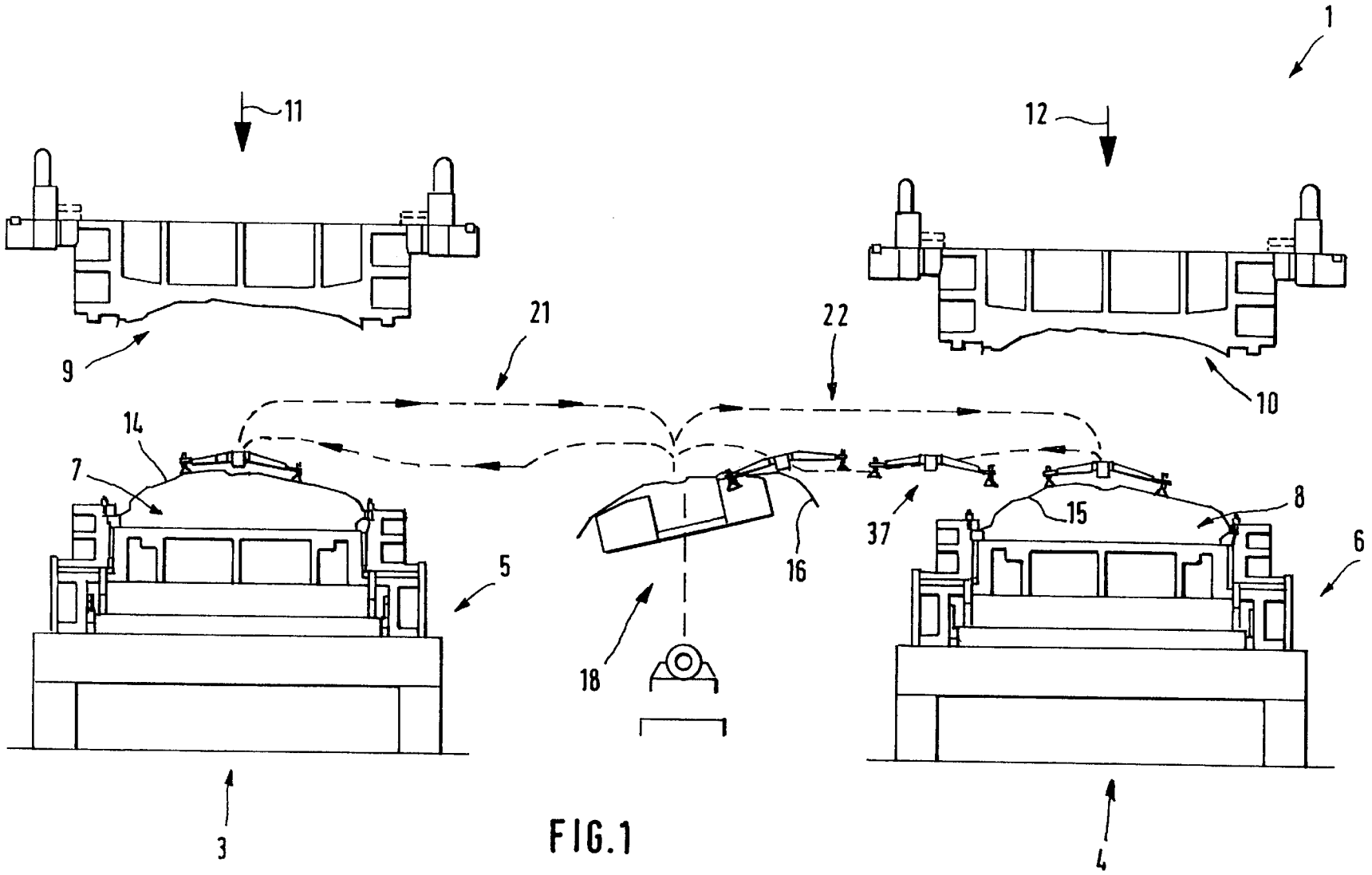
FIG. 1 is a cutout-type, schematic side view of a press system having several press stations and an intermediate depositing device.

FIG. 1 illustrates a press system 1 which has a succession of press stations, of which two press stations 3, 4 need be shown to understand the invention. Each press station 3, 4 includes a sliding table 5, 6 for receiving one bottom tool 7, 8 respectively to which a respective top tool 9, 10, which is held on a slide, is assigned. The top tools 9, 10 are synchronously moved up and down by the slides in a timed manner in the direction of the arrows 11, 12. In the press stations 3, 4 sheet metal parts 14, 15 are machined in steps. For a possibly required depositing of another sheet metal part 16 between the press stations 3, 4, an intermediate depositing device 18 may be arranged half way between the two sliding tables 5, 6. As may be required, this intermediate depositing device 18 has templates which are adjustable in several axes in order to take up the sheet metal part at the depositing device and, as required, align it for the conveying in the vertical and oblique position.

Figure 2:
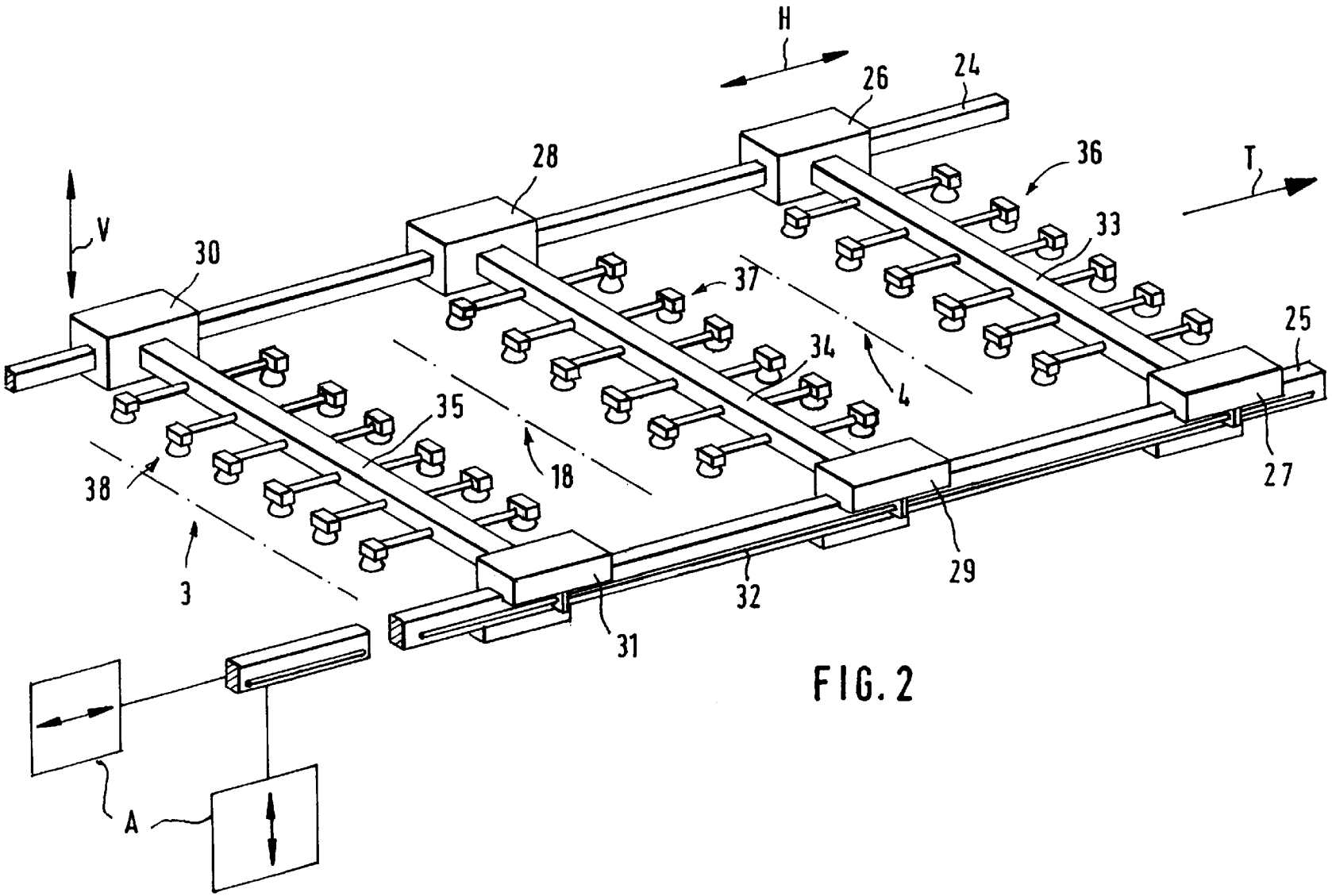
FIG. 2 is a schematic, simplified perspective view of a transfer device for the press system according to FIG. 1 with two travelling rails which are arranged parallel to one another and with a travelling carriage disposed thereon, between which cross traverses are arranged.

The sheet metal parts 14, 15, 16 are transported along a transfer curve 21, 22 from the press station 3 to the intermediate depositing device 18 and from the latter to the press station 4 or are transported directly from press station 3 to press station 4. As seen in FIG. 2, the transfer curves 21, 22 are formed by vertical lifting-lowering movements V to which a horizontal transport lift H is superimposed. It may be required in this situation that the sheet metal part 14, 15 or 16, already during the lift-out movement from the bottom tool 7, 8 or during the removal from the intermediate depositing device 18, is to be rotated into such a tilted position that, during the transport, low-drawn edges are not hindered by the respective bottom tool 7, 8 or the receiving device of the intermediate depositing device 18.

For the transfer of the sheet metal parts 14, 15, 16 as well as optionally for swivelling thereof, a transfer device 23 schematically shown in FIG. 2 is used. This transfer device includes two lifting beams or travelling rails 24, 25 which are spacedly arranged parallel to one another as well as parallel to a transport direction T. Respective travelling carriages 26, 27, 28, 29, 30, 31 are arranged on the travelling rails 24, 25 and are movable in the transport direction T. The carriages are driven by linkages 32 which are schematically shown. A cross traverse 33, 34, 35 is held between each pair of travelling carriages 26, 27; 28, 29; 30, 31. Each cross traverse is connected by its ends in a releasable manner with the respective travelling carriages 26, 27, 28, 29, 30, 31. Coupling devices which are shown, for example, in FIG. 3 are used for the connection.

Each cross traverse 33, 34, 35 carries suction spiders 36, 37, 38 as gripping devices for the sheet metal parts 14, 15, 16. At least the suction spiders 37 held on the cross traverse 34 are rotatably disposed on the cross traverse 34.

Figure 3:
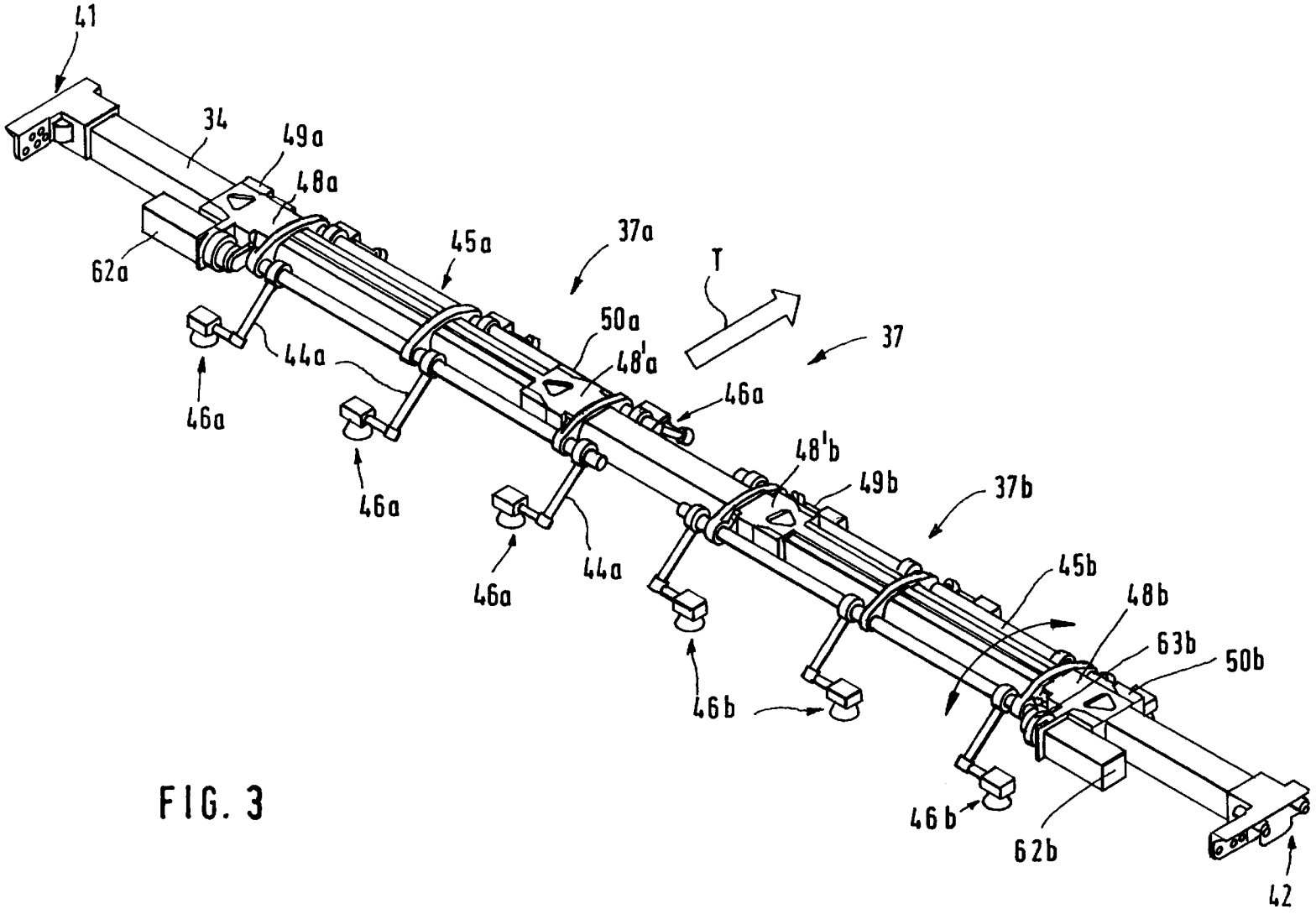
FIG. 3 is a simplified perspective view of a cross traverse of the transfer device according to FIG. 2 with two gripping units which can each be rotated separately about the cross traverses by a rotating device.

As illustrated in FIG. 3, the cross traverse 34 has a continuous rigid support which is constructed from a box-shaped profile and which is provided on its two ends with coupling halves 41, 42 for the connection with the travelling carriage 28, 29. The support carries two suction units 37*a*, 37*b* which are constructed mirror-symmetrically with respect to one another. The following description, which relates to the suction unit 37*a*, therefore applies correspondingly to the suction unit 37*b*.

Figure 4:
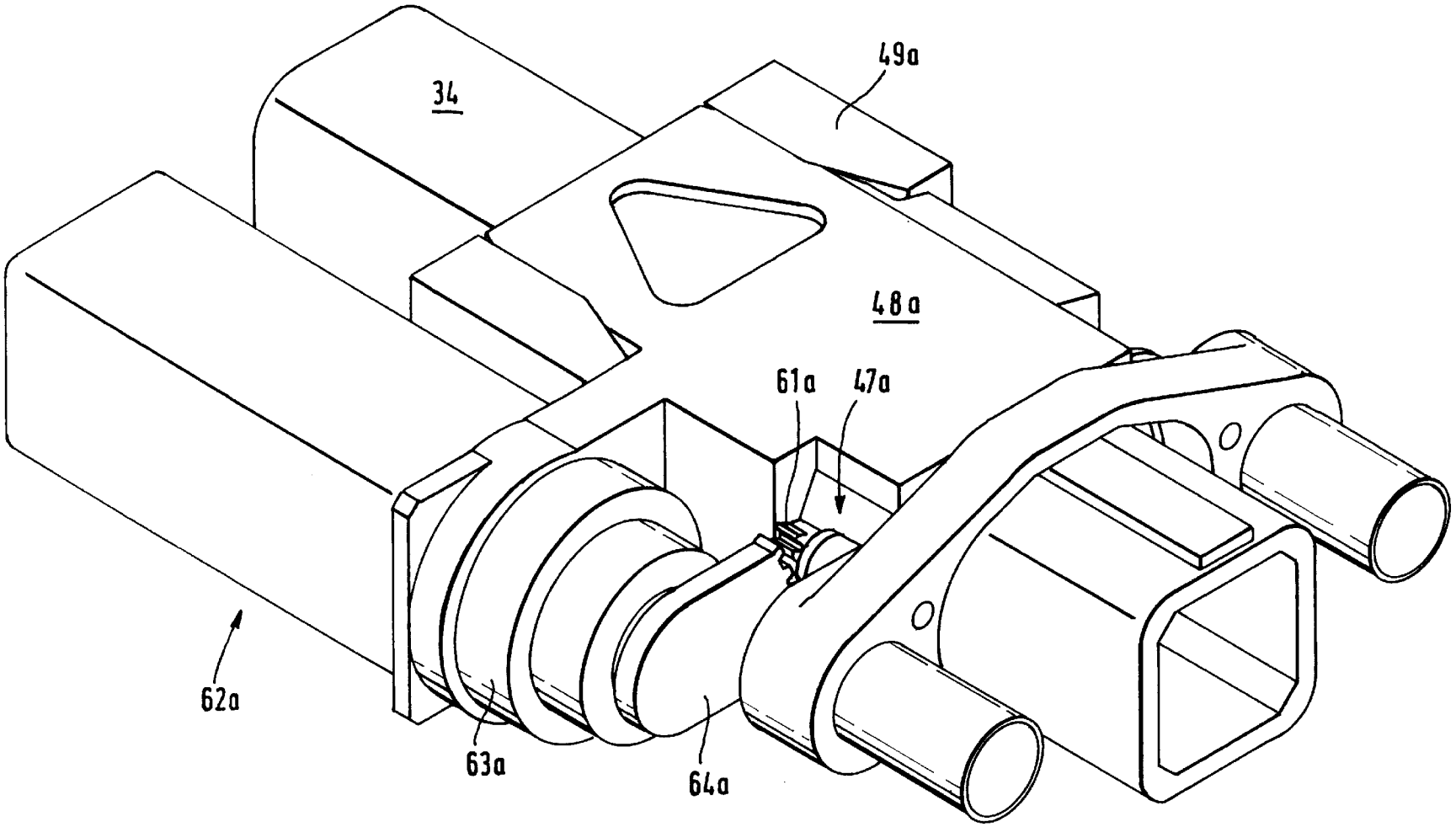
FIG. 4 is a schematic perspective view, on a larger scale, of a rotating unit of the gripping unit shown in FIG. 3.
Figure 5:
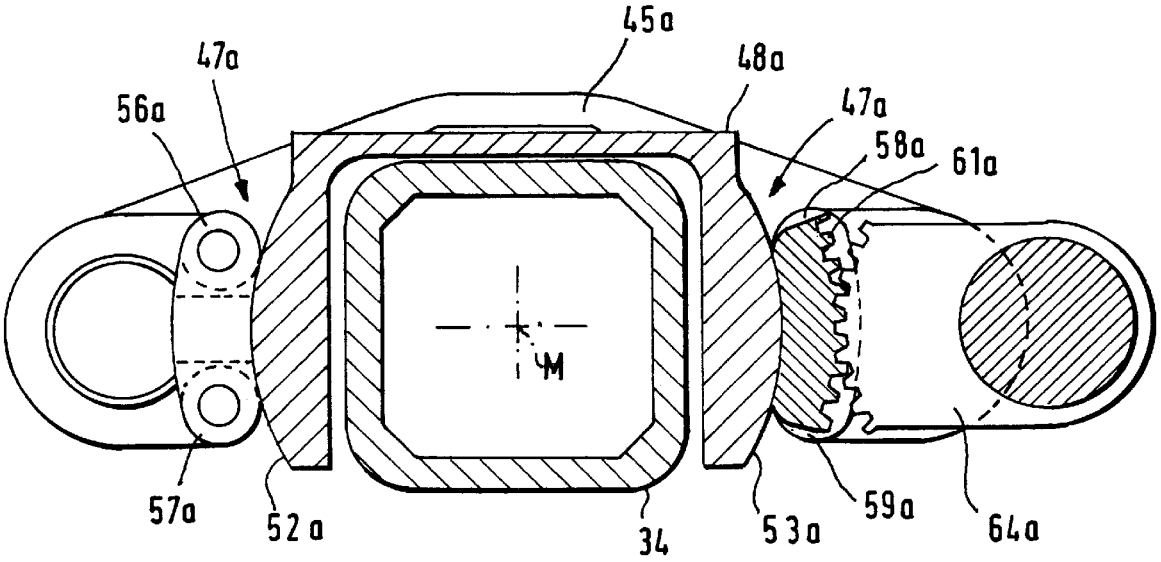
FIG. 5 is a cross-sectional view of the rotating unit shown in FIG. 4 which is cut through at a bearing device pertaining to the rotating unit.

The suction unit 37*a* includes several suction devices 46*a* which are connected with a frame 45*a* by way of arms 44*a*. A bearing arrangement 47*a* shown, for example, in FIGS. 4 and 5 disposes the frame 45*a* on a holding device 48*a* which can be coupled to corresponding pedestals 49*a*, 50*a* carried by the cross traverse 34 and arranged at a distance from one another. As best seen in FIG. 5, the holding device 48*a* surrounds the cross traverse 34 on three sides and is open toward the bottom. The same applies to part 46*a*' of the holding device which is connected with the pedestal 50*a*.

On the holding device 48*a*, 48*a*', spade-shaped projections, which are used as coupling counterparts and are constructed as inserting aids, as well as coupling pins are provided which are received by the pedestals 49*a*, 50*a* and which, together therewith, form a releasable coupling device. Securing devices prevent an unintentional release of the coupling arrangement.

The bearing device 47*a* is formed by curved surfaces 52*a*, 53*a* which are constructed on the holding device 48*a*, 48*a*' and which in pairs are situated on a common circle whose center point M corresponds to the center point of the cross traverse 34 (FIG. 5). The frame 45*a*, which is also open toward the bottom, is disposed, for example, by a total of four rollers 56*a*, 57*a*, 58*a*, 59*a* on the curved surfaces 52*a*, 53*a*. As an alternative to this bearing on rollers, for example, a curved profile rail guide is also contemplated.

A gear wheel segment 61*a*, which is connected with the frame 45*a* and is arranged laterally next to the rollers 58*a*, 59*a*, is used for the coupling of the frame 45*a* with a servo motor 62*a* which is arranged next to the holding device 48*a* at the same level as the cross traverse 34. By way of a high step-down, so-called harmonic drive gear 63*a* (FIG. 4), the servo motor 62*a* is connected with a lever 64*a* carrying a toothing on the end side. The lever 64*a* can also be considered to be a gear wheel segment and its toothing meshes with the gear wheel segment 61*a*. Thereby, its axis of rotation is aligned parallel to the axis of rotation of the frame 45*a*.

Corresponding to the timing of the press slide of the press stations 3, 4 illustrated in FIG. 1, corresponding drive units A move the travelling rails 24, 25 in the vertical direction V and the travelling carriages 26, 27, 28 29, 30, 31 in the horizontal direction H such that the cross traverses 33, 34, 35 move through the transfer curves 21, 22. The cross traverses 34, 35, which are shown in different path positions in the return lift, can thus be controlled such that, during the horizontal and/or vertical movement of the cross traverse 34, the suction spiders 37 (37*a*, 37*b*) swivel around the cross traverse 34. In this manner, the suction spiders 37 can be positioned in an oblique position in which they can be applied to the sheet metal part 16 held by the intermediate depositing device 18 in the tilted position.

With resetting movement at the cross traverse 34, the suction spiders 37 are rotated into this tilted position. As a result, the sheet metal part 16 is placed on the transfer curve 22 without disturbance into the bottom tool 8. Also, during the introduction of the sheet metal part 16 into the press station 4 or during the removal thereof from the press station 3, the part 16 can, as may be required, be brought into different tilted positions by the swivelling of the suction spiders 37.

The indicated rotating adjustments of the cross traverses are only examples. As the result of the free controllability of the servo motors 62 and an arbitrary exchange of the cross traverses 33, 34 for those which each carry on or several swivel unit(s), multiple combinations are possible. Instead of the swivel units, non-swivellable suction spiders may also be coupled to the pedestals 49, 50, which non-swivellable suction spiders are oriented in the horizontal direction or in an inclined direction. Together with corresponding extensions of the holding device 48*a*, 48*a*', the pedestals 49*a*, 50*a* illustrated in FIG. 3 form a coupling arrangement which is provided with a locking device. The particular coupling arrangement is unlocked by a short-lift movement directed axially to the cross traverse 34 and the swivelling-away of the locking pin, after which the suction unit 37*a*, 37*b* can be removed. As required, the coupling arrangement may also be replaced by other connection devices so that the concerned or particular suction unit 37*a*, 37*b* is fixedly connected with the respective cross traverse 34 (33, 35).

A transfer device 23 for a press system 1 has cross traverses 33, 34, 35 on each of which at least one suction unit 37*a* is held which is disposed on it to be swivellable about the cross traverse 34. The suction unit 37*a* has a preferably electric drive for coordinating the swivel movement with the transfer curve (horizontal and vertical movement) to be travelled. As may be required, two or more suction units 37*a*, 37*b* may also be arranged on a cross traverse and can be swivelled independently of one another. A retrofitting and retooling of existing cross traverses can be carried out by the replacement of non-swivellable suction used so far by swivellable suction units. Other changes of the mechanical structure of the transfer device 23 are thus not required.

Although the invention has been described and illustrated in detail, it is to be clearly understood that the same is by way of illustration and example, and is not to be taken by way of limitation. The spirit and scope of the present invention are to be limited only by the terms of the appended claims.

What is claimed is:

1. Transfer device for transfer of workpieces between press stations along a given transfer direction, comprising supporting and guiding devices which extend essentially along the transfer direction and which carry therebetween cross transverses equipped with gripping devices arranged to be engaged with and disengaged from the workpieces, and driving devices configured to be operated independently of the supporting and guiding devices and configured to act upon the gripping devices for swivelling the gripping devices about an axis of rotation transverse to the transfer direction, wherein at least one of the cross traverses carries a bearing device on which the associated gripping device is operatively disposed to be swivelled about the axis of rotation, and is configured to carry the associated driving device for swivelling the gripping device such that the gripping device and its associated bearing device, can be installed or replaced completely independently of the supporting and guiding devices.

2. Transfer device according to claim 1, wherein an arrangement is configured to couple the cross traverse and the associated swivellable gripping device and extends transversely to the transfer direction.

3. Transfer device for transfer of workpieces between press stations along a given transfer direction, comprising supporting and guiding devices which extend essentially along the transfer direction and which carry therebetween cross transverses equipped with gripping devices arranged to be engaged with and disengaged from the workpieces, and driving devices configured to act upon the gripping devices for swivelling the gripping devices about an axis of rotation transverse to the transfer direction, wherein at least one of the cross traverses carries a bearing device on which the associated grilling device is operatively disposed to be swivelled about the axis of rotation, and is configured to carry the driving device for swivelling the gripping device, and the bearing device is configured such that the axis of rotation is situated within the cross traverse.

4. Transfer device according to claim 3, wherein the bearing device comprises at least one bearing unit having two mutually spaced curved guiding surfaces situated on a common circle and on which the gripping devices having a gear wheel segment are disposed via rollers, and the driving device comprises a geared motor which is drivingly connected with the gear wheel segment.

5. Transfer device according to claim 3, wherein, each of the driving devices is operatively arranged between respective ones of the cross traverses and the gripping devices.

6. Transfer device according to claim 3, wherein each of the gripping devices and the driving devices constitute a unit configured to be removable from the respective one of the cross traverses.

7. Transfer device according to claim 6, wherein, each of the driving devices is operatively arranged between respective ones of the cross traverses and the gripping devices.

8. Transfer device for transfer of workpieces between press stations along a given transfer direction, comprising supporting and guiding devices which extend essentially along the transfer direction and which carry therebetween cross transverses equipped with gripping devices arranged to be engaged with and disengaged from the workpieces, and driving devices configured to act upon the gripping devices for swivelling the gripping devices about an axis of rotation transverse to the transfer direction, wherein at least one of the cross traverses carries a bearing device on which the associated gripping device is operatively disposed to be swivelled about the axis of rotation, and is configured to carry the driving device for swivelling the gripping device, and said at least one cross traverse carries at least two gripping devices wherein each of the gripping devices is configured to be swivellable independently of the other.

9. Transfer device for transfer of workpieces between press stations along a given transfer direction, comprising supporting and guiding devices which extend essentially along the transfer direction and which carry therebetween cross transverses equipped with gripping devices arranged to be engaged with and disengaged from the workpieces, and driving devices configured to act upon the gripping devices for swivelling the gripping devices about an axis of rotation transverse to the transfer direction, wherein at least one of the cross traverses carries a bearing device on which the associated gripping device is operatively disposed to be swivelled about the axis of rotation, and is configured to carry the driving device for swivelling the gripping device, and at least one other of the cross-traverses comprises a gripping device which is non-rotatably held on said at least one other of the cross traverses.

10. Transfer device according to claim 3, wherein each the gripping devices is provided with vacuum-operated suction devices.

11. Transfer device according to claim 3, wherein the cross traverses are configured to be releasable from the supporting and guiding devices.

12. Transfer device according to claim 3, wherein the supporting and guiding devices are travelling rails on which travelling carriages are disposed to be movable in the transfer direction, with which the cross traverses being releasably connected with the travelling carriages and driving devices for the targeted movement in the transfer direction being assigned to the travelling carriages, and further driving devices being assigned to the travelling rails for lifting and lowering thereof.

* * * * *